United States Patent [19]

Allegrucci

[11] Patent Number: 5,050,797

[45] Date of Patent: Sep. 24, 1991

[54] RAIL FASTENING FOR POINTS OF RAILWAY TRACKS

[75] Inventor: Jean-Pierre Allegrucci, Schifflange, Luxembourg

[73] Assignee: Kihn S.a.r.l., Luxembourg

[21] Appl. No.: 479,450

[22] Filed: Feb. 13, 1990

[30] Foreign Application Priority Data

Feb. 14, 1989 [LU] Luxembourg ..... 87450

[51] Int. Cl.[5] ..... E01B 9/00

[52] U.S. Cl. ..... 238/336; 238/349

[58] Field of Search ..... 238/125, 315, 331, 332, 238/336, 337, 338, 339, 349, 352; 411/542, 544, 150

[56] References Cited

U.S. PATENT DOCUMENTS

| | | | |
|---|---|---|---|
| 1,563,220 | 11/1925 | Nagel | 238/336 |
| 2,211,021 | 8/1940 | Mathias | 238/315 |
| 2,228,461 | 1/1941 | Kelly, Jr. | 238/349 |
| 2,636,687 | 4/1953 | Arnold et al. | 238/336 |
| 4,119,271 | 10/1978 | Campbell | 238/349 |
| 4,479,607 | 10/1984 | Okumura et al. | 238/349 |
| 4,705,215 | 11/1987 | Eisenberg et al. | 238/338 |

FOREIGN PATENT DOCUMENTS

| | | | |
|---|---|---|---|
| 2212842 | 8/1989 | United Kingdom | 238/338 |

*Primary Examiner*—Robert J. Spar
*Assistant Examiner*—Craig Slavin
*Attorney, Agent, or Firm*—Fishman, Dionne & Cantor

[57] ABSTRACT

The fastening comprises a fastening shoe having, overall, an "L"-shaped cross-section, one of the branches of which is bolted with vertical elasticity to a sole-plate secured to a railway sleeper and the other branch of which is bolted with lateral elasticity to the web of the rail on the side opposite the movable point.

4 Claims, 1 Drawing Sheet

Fig.1
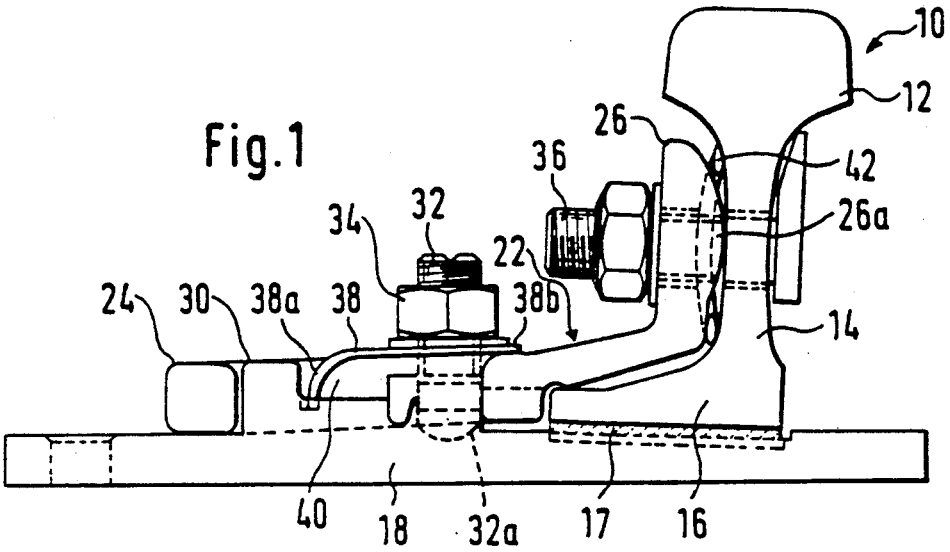
Fig. 2
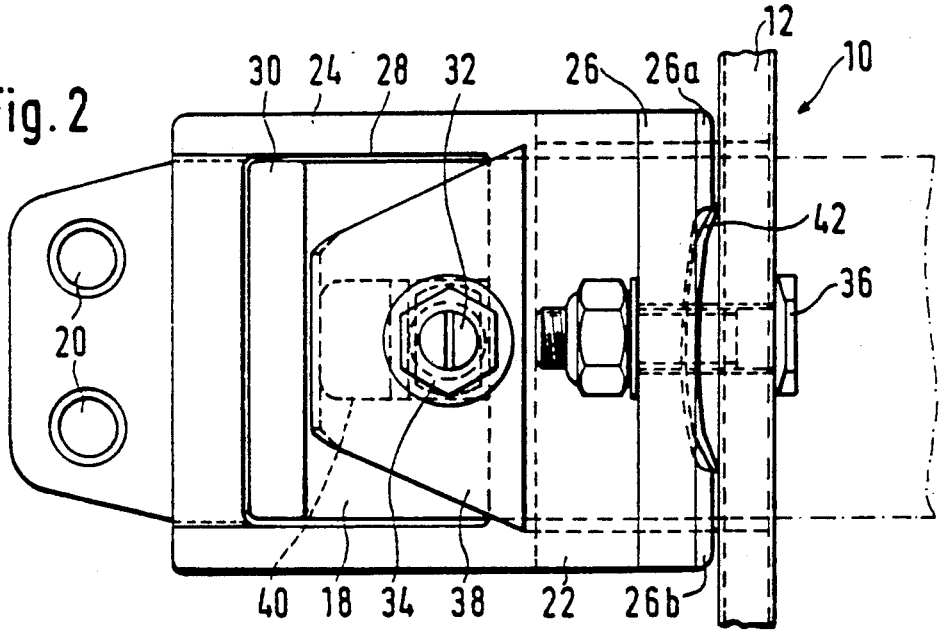
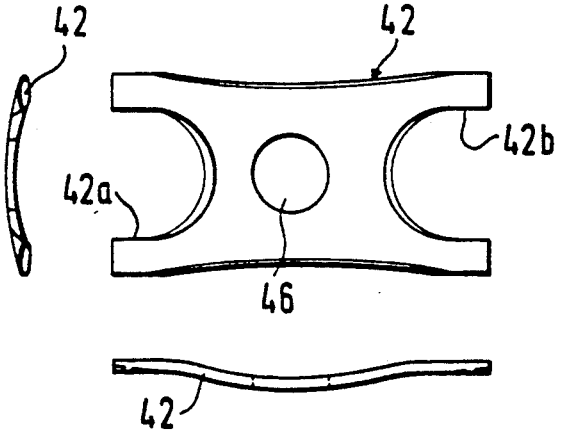
Fig. 3

RAIL FASTENING FOR POINTS OF RAILWAY TRACKS

TECHNICAL FIELD

The present invention relates to a rail fastening for points of railway tracks, in which the inner foot of the rail is removed to permit the installation of a movable point which is transversely displaceable relative to the web of the rail.

BACKGROUND OF THE INVENTION

Railway rails are not fastened rigidly to their sleepers, but are fastened in such a way as to retain a certain flexibility in order to better withstand the numerous stresses to which they are subjected, in particular those resulting from expansions and those imposed by the passage of trains. For this purpose, the longitudinal edges of the foot of each rail are fastened to the sleepers by flexible collars the edges of which bear on the foot of the rails under the action of the clamping bolts screwed into the sleepers or into base plates secured to the sleepers.

In view of the fact that these flexible fastenings are located on both sides of the rail, they permit not only a certain vertical elasticity, but also a transverse elasticity in the sense of a compensation for the overturning movements produced in particular when the railway trains change direction.

Unfortunately, until now it has been necessary to interrupt this elastic fastening of the rails in the region of the points, or at least the points which necessitate the removal, over a certain length, of the foot of the rail on the side of the point in order to permit the lateral displacement of the latter relative to the fixed rails. In fact, the absence of the foot of the rail rules out any possibility of fastening the latter on the side of the movable point. Now, it is precisely in the region of the points, where there is necessarily always a change of direction, that this inner fastening would appear to be important, since it is essential to support the rail against the horizontal overturning moment to which it is subjected in the direction opposite the point.

In order to contain these transverse forces on the rail, they are fastened, on the outer side, i.e. the side opposite that where the foot is removed for the installation of the point, by means of a fastening shoe which is bolted to the web of the rail and which opposes the overturning moment of the latter. However, this rigid fastening with the aid of such a show negates the effect of a conventional elastic vertical fastening which, in theory, would always be possible on this outer side, but which is thus rendered superfluous by the rigid fastening of the shoe.

Now, not only does this rigid fastening disrupt the continuity of the flexibility of the track in the region of the points, but, in addition, it leads to other disadvantages such as, for example, acceleration of wear, maintenance difficulties and the risk of the bolts loosening under the action of the vibrations, etc.

SUMMARY OF THE PRESENT INVENTION

The object of the present invention is to provide an elastic fastening of the rails in the region of the points, which eliminates the disadvantages described above.

In order to achieve this objective, the fastening proposed by the present invention is characterized, in its preferred embodiment, by the combination of a fastening with vertical elasticity between the fastening shoe and the base plate and a fastening with lateral elasticity of the rail relative to the base plate.

The fastening with vertical elasticity may be formed, after the fashion of the known elastic fastenings, by a flexible collar provided between the shoe and its adjusting nut.

The fastening with lateral elasticity is formed, according to a preferred embodiment, by a flexible curved plate arranged between the shoe and the web of the rail.

Consequently, the present invention makes it possible to dissociate the vertical support form the horizontal support by virtue of two flexible fastenings which are mutually complementary to the extent that the one is able to exert its effects only by virtue of the presence of the other and vice versa, which allows the rails to retain their natural flexibility when a train passes over the points.

According to a preferred embodiment, the curved plate of the fastening with lateral elasticity has a substantially rectangular shape with cutouts on the two opposite lateral sides so as to exhibit, overall, the shape of an "H", the four arms of which bear on the web of the rail and the center of which bears on the shoe and has passing through it a bolt for fastening the latter to the rail. In order to facilitate the relative movements and allow the elastic fastenings to exert their effects, the edges of the fastening shoe and also the points of contact are rounded.

BRIEF DESCRIPTION OF THE DRAWINGS

Other features and characteristics will emerge from the description of an advantageous embodiment presented below, by way of illustration, with reference to the accompanying drawings in which;

FIG. 1 shows a vertical section through a rail and its fastening in the region of the points:

FIG. 2 shows a plan view of the representation of FIG. 1 and

FIG. 3 shows side, front, and plan views of the curved plate which ensures the lateral elasticity.

DETAILED DESCRIPTION OF THE INVENTION

FIGS. 1 and 2 show a conventional railway rail comprising a head 12, a vertical web 14 and a foot 16, via which the rail 10 rests, by means of a base-plate pad 17, for example of neoprene, on a sole-plate 18 -which is bolted at 20 to a railway sleeper. As shown in FIG. 1, the inner part of the foot, to the right of the figure, is removed to permit the installation of a point (not shown) which is laterally displaceable relative to the rail 10. In order to oppose the moment exerted on the rail 10 outwards, i.e. towards the left in the figure or on the opposite side, a fastening shoe 22 is provided as shown in FIGS. 1 and 2. This shoe 22 is generally "L"-shaped with a horizontal section 24 and a vertical section 26. The horizontal section 24 of the shoe 22 has a positioning opening 28 which, is association with a corresponding rib 30 of the sole-plate 18, facilitates the correct positioning of the shoe 22. This shoe 22 is fastened vertically to the sole-plate 18 with the aid of a bolt 32 and a nut 34. The bolt 32 is, for example, retained in the sole-plate 18 by an enlarged head **32*a* capable of penetrating through a keyhole opening in a hollow part of the sole-plate 18**, or alternatively is retained therein by virtue of a head in the form of a hammer.

The vertical section 26 of the shoe 22 bears on the web 14 of the rail 10 and is fixed thereto with the aid of a bolt 36.

However, in contrast to the prior art, according to which the fastenings by the two bolts 32 and 36 are rigid, the present invention renders these two fastenings elastic. For this purpose, the vertical fastening in the region of the bolt 32 is formed by means of a collar 38 constructed in the form of a flexible tongue, the outer edge 38*a* of which is curved down and rests on a supporting base 40, of corresponding shape, which rises from the sole-plate 18 in the opening 28 of the shoe 22 and the opposite edge 38*b* of which bears elastically on the inner edge of the opening 28 of the shoe 22 under the tightening action of the nut 34. This vertical elastic bearing is transmitted via the shoe 22 to the foot 16 of the rail 10.

This vertical elastic fastening is complemented, according to the present invention, by a lateral elastic fastening which, in the example shown, is located between the shoe 26 and the web 14 of the rail 10. As can be seen in FIGS. 1 and 2 and in greater detail in FIG. 3, the flexible bearing of the shoe 22 on the rail 10 is producted by inserting a flexible curved plate 42 between these two elements. This plate 42 has a substantially rectangular shape with two cutouts 42*a*, 42*b* on the two opposite lateral sides so as to define the shape of an "H". This plate is curved so that the central region, which is in contact with the shoe 26, is resilient relative to the four ends which bear on the web 14 of the rail 10. The central region of the plate 42 has an opening 46 to allow the bolt 36 to pass through The four ends of the plate 42 are arranged and designed as a function of the shape of the web 14 of the rail so as to ensure positioning of the plate 42 against the rail. In order to allow the collar 38 and the plate 42 to exert their effect to the full so as to permit a certain elastic mobility of the rail 10 both in the vertical direction and in the sense of pivoting outwards, it is preferable that, as shown in FIG. 1, the lower edges of the rear bar of the horizontal section 24, via which the latter bears on the sole-plate 18, and also the point of contact between the shoe 22 and the foot 16 are rounded in order to facilitate the relative mobility between these elements, a mobility which is necessary to ensure the flexible freedom of the rail 10.

In order to prevent the plate 42 from breaking, in the event of extreme stresses, the vertical section 26 of the shoe 22 has, on the face adjacent to the rail 12, two lateral stops 26*a* and 26*b*, which are able to bear, through the cutouts 42*a* and 42*b*, on the web 14 of the rail after a certain amount of bending of the plate 42.

The shape of the shoe 22 is designed to permit its mounting and its mounting and its dismounting without having to move or dismount the rail.

Naturally, the form of the elastic elements 38 and 42, as shown in the figures, is only one exemplary embodiment and it is possible for these elements to be given different forms provided that they perform the same functions. It is even possible to replace the collar 38 by a flexible claw which performs the fastening functions and which thereby makes the presence of the bolts 32 superfluous.

Futhermore, although the position of the plate 42 between the shoe 22 and the rail 10 is a preferred position, it is possible to provide a fixed connection between the shoe 22 and the rail 10 and to provide a flexible support between the shoe 22 and the sole-plate 18, in particular in the region of the rear edge of the opening 28. Such a flexible support would allow, in fact, the same degrees of freedom as those provided by the plate 42.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A device for fastening a rail of a railway track to a railway sole plate, wherein the rail includes a head, a web, said web having inner and outer sides extending vertically downwardly from the head, and an outer foot, said foot extending horizontally from the outer side of the web and wherein the rail lacks an inner foot to permit installation of a movable rail point which is transversely displaceable relative to the inner side of the web, comprising:

a fastening shoe, said shoe comprising a horizontally extending first portion and a vertically extending second portion;

first fastening means for flexibly securing the first portion of the shoe to the sole plate; and second fastening means for flexibly securing the second portion of the shoe to the outer side of the web;

wherein the web and the second portion of the shoe each include bolt holes and the second fastening means comprise a bolt extending through said bolt holes from a head to a threaded end, an adjusting nut threadably engaging said threaded end of said bolt and a flexible curved plate disposed between the second portion of the shoe and the web;

said apparatus supporting the track against lateral overturning moments while providing vertical elasticity between the shoe and the sole plate and lateral elasticity of the rail relative to the sole plate.

2. An apparatus for fastening a railway track to a railway sole plate, wherein the track includes a head, a web, said web having first and second sides extending vertically downwardly from the head, and a foot, said foot extending horizontally from one side of the web, comprising:

a fastening shoe, said shoe comprising a horizontally extending first portion and a vertically extending second portion;

first fastening means for flexibly securing the first portion of the shoe to the sole plate; and second fastening means for flexibly securing the second portion of the shoe to the web of the track;

wherein the web and the second portion of the shoe each include bolt holes and the second fastening means comprises a bolt extending through said bolt holes from a head to a threaded end, an adjusting nut threadably engaging said threaded end of said bolt and a flexible curved plate disposed between the second portion of the shoe and the web; and wherein the flexible curved plate comprises a substantially rectangular flexible curved plate and further comprises a central portion for contacting the second portion of the shoe, a bolt hole through the central portion and cutouts on opposite lateral sides to define four arms extending from the central portion for contacting the web.

3. The apparatus of claim 2, where the second portion of the shoe further comprises stop means for contacting the web to prevent excessive deformation of the flexible curved plate.

4. The apparatus of claim 2, wherein flexible curved plate is contoured to compliment the web and permit positioning of the plate against the web.

* * * * *